US005119791A

United States Patent [19]

Gifford et al.

[11] Patent Number: 5,119,791

[45] Date of Patent: Jun. 9, 1992

[54] VAPOR STORAGE CANISTER WITH LIQUID TRAP

[75] Inventors: William E. Gifford, Hemlock; Otto M. Girard, Jr., Rochester; Charles H. Covert, Manchester, all of N.Y.; Samuel Yu, Fairfax, Va.; Gordon R. Paddock; Richard H. Simons, Jr., both of Rochester, N.Y.

[73] Assignee: General Motors Corporation, Detroit, Mich.

[21] Appl. No.: 711,761

[22] Filed: Jun. 7, 1991

[51] Int. Cl.[5] ..... F02M 33/02

[52] U.S. Cl. ..... 123/519; 123/516; 55/387

[58] Field of Search ..... 123/516, 518, 519, 520, 123/521; 55/387, 418, 462

[56] References Cited

U.S. PATENT DOCUMENTS

| | | | |
|---|---|---|---|
| 3,646,731 | 3/1972 | Hansen | 55/316 |
| 4,058,380 | 11/1977 | King, II | 55/387 |
| 4,308,840 | 1/1982 | Hiramatsu et al. | 123/519 |
| 4,326,489 | 4/1982 | Heitert | 123/520 |
| 4,338,106 | 7/1982 | Mizuno et al. | 55/387 |
| 4,507,132 | 3/1985 | Yoshida | 123/519 |
| 4,527,532 | 7/1985 | Kasai et al. | 123/520 |
| 4,658,796 | 4/1987 | Yoshida et al. | 123/516 |
| 4,683,862 | 8/1987 | Fornuto et al. | 123/520 |
| 4,703,736 | 11/1987 | Atkins, Sr. | 123/516 |
| 4,714,485 | 12/1987 | Covert et al. | 55/189 |
| 4,750,465 | 6/1988 | Rediker, Jr. et al. | 123/519 |
| 4,750,923 | 6/1988 | Haruta et al. | 55/387 |
| 4,951,643 | 8/1990 | Sato et al. | 123/519 |
| 4,986,840 | 1/1991 | Mori et al. | 123/519 |

*Primary Examiner*—Tony M. Argenbright
*Assistant Examiner*—Thomas N. Moulis
*Attorney, Agent, or Firm*—Patrick M. Griffin

[57] ABSTRACT

A vapor storage canister incorporates a liquid trap that protects the carbon bed, but which avoids purging liquid directly out of the trap. The trap consists of a cup that forms an interior cavity at the bottom of, and surrounded by, the carbon bed. The purge tube does not enter the trap directly, but instead runs to a plenum that draws from the bottom face of the carbon bed. The trap, in turn, is open to the interior of the carbon bed only through a screen mesh grid. Consequently, vapor can be pulled from the trap at purge, but not liquid.

2 Claims, 2 Drawing Sheets

VAPOR STORAGE CANISTER WITH LIQUID TRAP

This invention relates to fuel vapor storage canisters in general, and specifically to a canister with a liquid fuel trap that protects the adsorbent bed, but which does not allow liquid fuel to feed directly to the engine when the canister is purged.

BACKGROUND OF THE INVENTION

Vehicle fuel systems have for some time incorporated a fuel vapor storage canister with a bed of activated carbon that adsorbs fuel vapors vented from the fuel tank. Stored vapors are later purged by applying engine vacuum to the canister, drawing atmospheric air through the bed to desorb fuel vapor, which is fed to the engine and burned. The fuel tank does not vent just vaporized fuel, however, but a mixture that contains a component of entrained liquid fuel. The efficiency of the carbon bed is reduced by direct contact with liquid fuel, so it is useful to incorporate a liquid trap in the canister to separate the liquid fuel component and keep it isolated from the carbon bed. It is also desirable that the liquid trap be located below the carbon bed, so that trapped fuel cannot slosh out of the trap and into the carbon bed.

Two co-assigned U.S. Pat. Nos., 4,714,485 and 4,750,465, show several embodiments of liquid trap canisters. A potential drawback of the disclosed designs is the fact that the purge tube opens directly into the liquid trap. Therefore, liquid fuel is pulled directly from the trap and fed to the engine to be burned. This may over enrich the engine fuel-air ratio for some vehicles. The purge tube opening can be restricted in size to reduce the rate at which liquid is drawn out, but that also reduces the rate at which vapor may be purged.

SUMMARY OF THE INVENTION

The invention provides a liquid trap canister in which the carbon bed is well isolated from liquid fuel, but in which liquid fuel is not drawn directly from the trap.

In the preferred embodiment disclosed, the canister is a closed bottom cylinder with a fresh air intake at the top. A liquid trap is provided by a central cup located within and near the bottom of the carbon bed. The cup is closed, except for a fill tube from the tank that opens into its upper end and an upper grid that provides a direct interface with the interior of the carbon bed. The grid mesh is fine enough to hold the carbon granules out of the cup, but presents a good deal of surface area through which fuel vapor can exit the cup to be adsorbed. A bottom end cover on the canister housing creates a plenum below the lower face of the carbon bed and below the cup that is open to the cup only indirectly, through the carbon bed and the grid. A central purge tube extends all the way through the carbon bed and cup into the plenum, but it has no direct fluid communication with the cup.

When the fuel tank vents through the fill tube to the canister, fuel vapor and entrained liquid enter the cup first. Liquid fuel settles out in the cup, below the grid, and is isolated from direct contact with the carbon bed. Fuel vapor, both that which enters the cup from the tank and that which later vaporizes from the trapped liquid, enters the carbon bed through the grid and is adsorbed. During purge, vacuum applied to the purge tube is applied not to the cup directly, but to the carbon bed, through the plenum. Atmospheric air is drawn down through the carbon bed to desorb stored fuel vapor. The application of vacuum to the bed enhances the evaporation of trapped liquid fuel through the grid and into the bed, but liquid fuel is not directly drawn from the cup to be fed to the engine.

It is, therefore, a general object of the invention to protect the carbon bed from liquid contamination while purging vapor efficiently without over enriching the feed to the engine.

It is another object of the invention to protect the carbon bed with a liquid trap that directly receives the mixture vented from the fuel tank, but is bypassed by the purge flow, so that trapped liquid fuel is not fed directly to the engine during purge.

It is another object of the invention to provide such a liquid trap that has an upper grid to pass fuel vapor to the carbon bed, so that trapped liquid can be purged only after it has first vaporized into the carbon bed.

DESCRIPTION OF THE PREFERRED EMBODIMENT

These and other objects and features of the invention will appear from the following written description, and from the drawings, in which.

Figure 1:
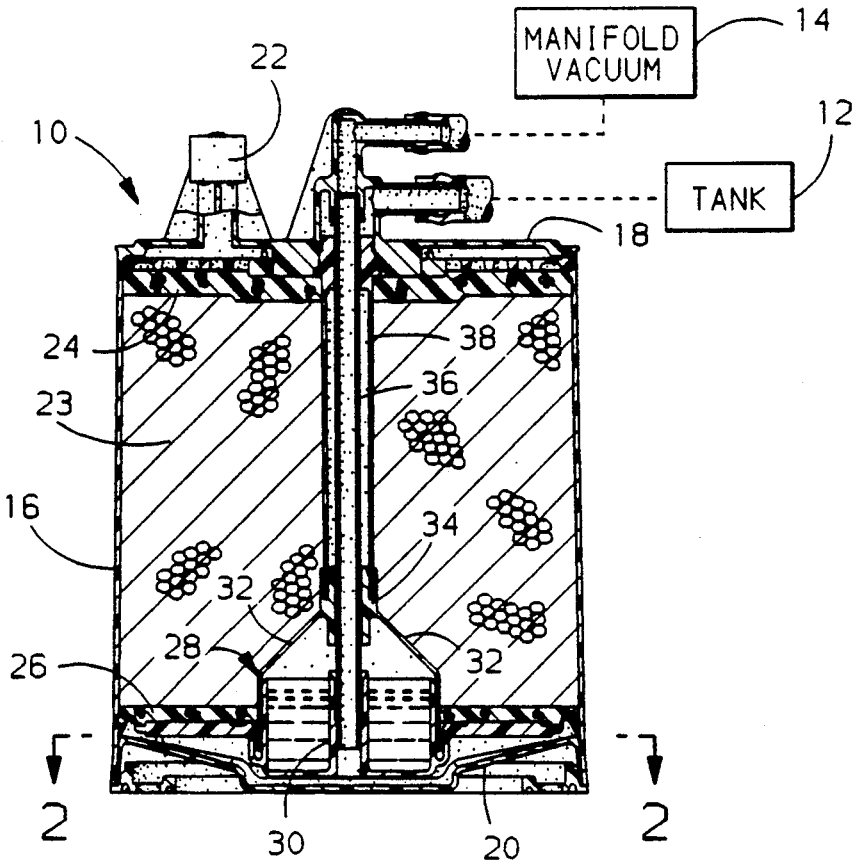
FIG. 1 is a cross section of a preferred embodiment of a fuel emissions storage canister embodying the invention.

Referring first to FIG. 1, a preferred embodiment of a storage canister embodying the invention is indicated generally at 10. Canister 10 is incorporated in a conventional vehicle fuel system that has a fuel tank 12 and an engine with a source of manifold vacuum 14. Fuel tank 12 produces an excess of vaporized and entrained liquid fuel that must be vented to prevent over pressurization. This is stored temporarily in canister 10, later to be purged by manifold vacuum 14 and ultimately burned in the engine. Canister 10 includes a cylindrical housing 16 with an upper end cover 18 and an internally ribbed bottom end cover 20. A fresh air intake 22 opens through upper cover 18. Housing 16 is substantially filled by a fuel vapor absorbent bed 23 of activated carbon granules, sandwiched between a pair of upper and lower foam screen and vent plate assemblies, 24 and 26, respectively. Each of the assemblies 24 and 26 is solidly fixed to housing 16, forming upper and lower faces respectively of bed 23, through which flow into or out of bed 23 occurs. Fresh air intake 22 opens from atmosphere to the upper face of bed 23, while bottom cover 20 encloses and forms an air tight plenum below the lower face of bed 23. The structure described thus far is basically conventional. Additional structure, described next, works within the otherwise conventional framework of canister 10 to provide improved protection for carbon bed 23.

Figure 2:
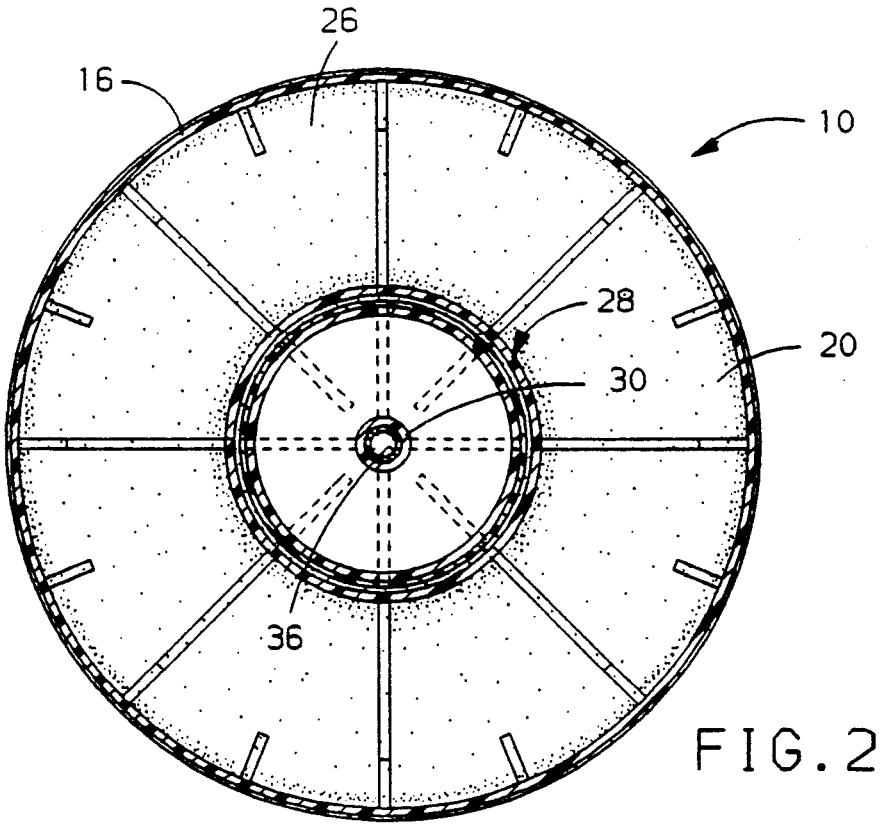
FIG. 2 is a cross sectional view taken along the line 2—2 of FIG. 1.
Figure 3:
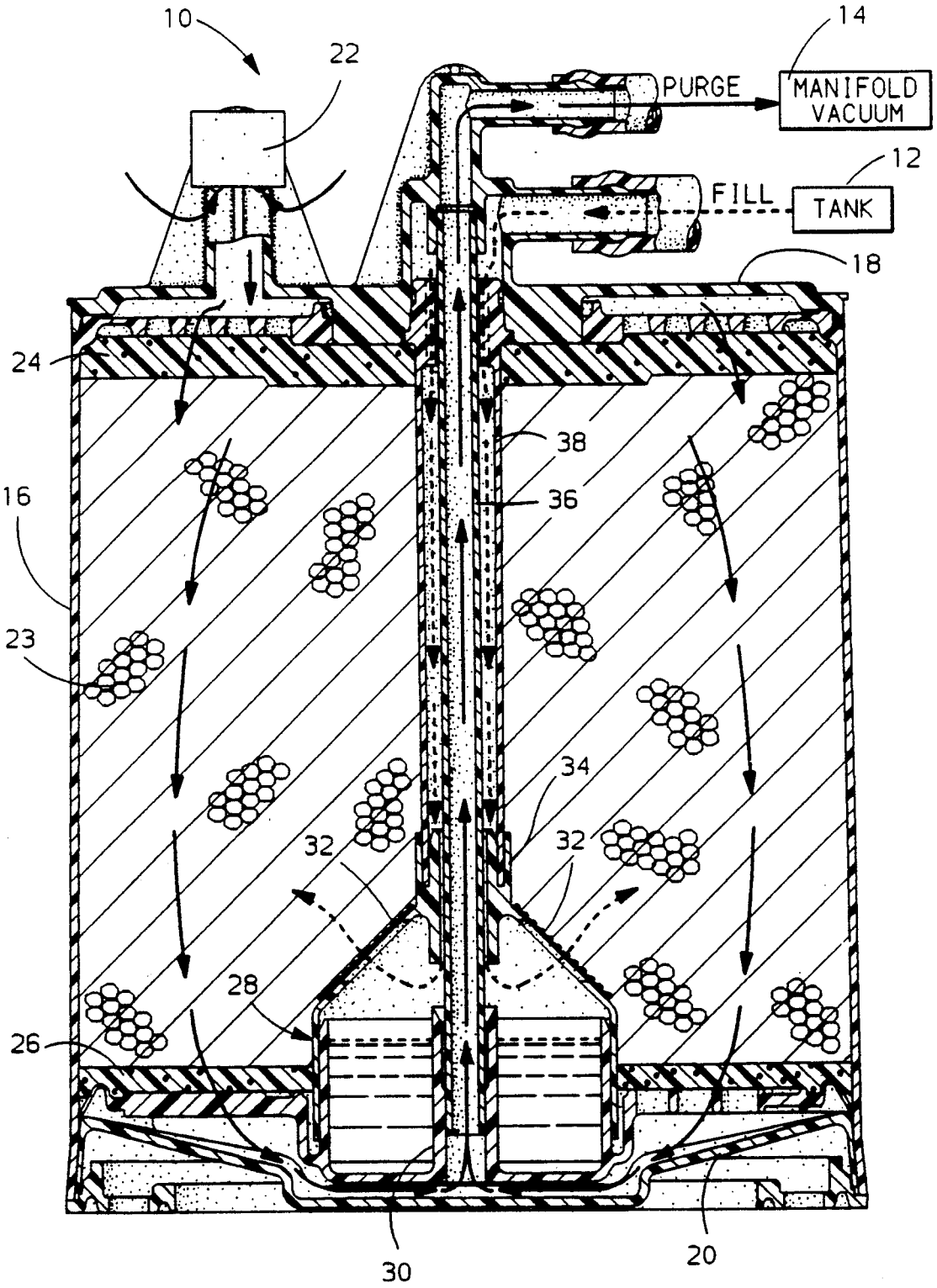
FIG. 3 is a view like FIG. 1 illustrating the fill and purge flow paths.

Referring next to FIGS. 2 and 3, a cup, indicated generally at 28, is located at bottom dead center of housing 16, embedded within and surrounded by the carbon bed 23, creating an internal cavity. Cup 28 is basically cylindrical, with a conical cap or roof that gives it a general beehive shape. The bottom of cup 28 extends partially through the bottom screen and plate assembly 26, with which it is integrally formed, and from which it receives solid support at the center of housing 16. The ribbed bottom cover 20 maintains an air space between itself and the bottom of cup 28, always open to the plenum that exists below the lower screen and plate assembly 26. Cup 28 is closed, except for a central stand pipe 30, four evenly spaced upper grids 32, and a central socket 34 above the grids 32. The grids 32 consist of a screen mesh fine enough to hold out the granules of the bed 23, but coarse enough to allow ample vapor interface area with the interior of cup 28. A central purge tube 36 passes through upper end cover 18, down through carbon bed 23 and through socket 34 into cup 28. There is radial clearance between the outside of purge tube 36 and socket 34, for a reason described below. The lower end of purge tube 36 is inserted tightly into cup stand pipe 30, while the upper end is connected to manifold vacuum 14. Therefore, while purge tube 36 runs through cup 28, it is not open to cup 28. A fill tube 38 is formed by a coaxial sleeve that passes through upper end cover 18, surrounding purge tube 36 with a radial clearance. The lower end of fill tube 38 is inserted tightly into socket 34, while the upper end is connected to the vapor space of fuel tank 12. Fill tube 38 does open to the interior of cup 28, through the radial space referred to above, but there is no direct interconnection between fill tube 38 and purge tube 36. In the complete canister 10, therefore, the only direct openings between cup 28 and bed 23 are the grids 32.

Referring next to FIG. 3, the operation of the invention is illustrated. Both the fill and purge flow paths are indicated by arrows, but it will be understood that conventional switching valves would be operated to close off the fill path during purge, and vice versa. When fuel tank 12 is venting to canister 10, the mixture of fuel vapor and entrained liquid fuel referred to above is routed initially to cup 28 through the central fill tube 38, as shown by the downwardly directed arrows. The mixture cannot contact bed 23 as it moves through fill tube 38, and after it enters cup 28, the entrained liquid component settles out in the bottom of cup 28, as shown. The fuel vapor component migrates to bed 23 through the grids 32 and is adsorbed, as shown by the dotted arrows. The central location of cup 28 allows it to serve as an efficient manifold, feeding vapor to bed 23 so that it migrates axially up and radially outwardly to evenly and symmetrically fill the entire bed 23. The trapped liquid in cup 28 is unlikely to contact bed 23 directly. Since it is located low relative to bed 23, the trapped liquid in cup 28 is not liable to spill over and down into bed 23. Cup 28 is also large enough in volume that the trapped liquid should not normally rise high enough to reach the grids 32. Also, trapped fuel will itself be continually vaporizing, just as the liquid fuel in tank 12 does.

Still referring to FIG. 3, purge is initiated by applying manifold vacuum from 14 to purge tube 36. Vacuum is not applied directly to cup 28, but to the plenum below the carbon bed 23. Air from atmosphere is drawn through air intake 22, and through upper screen assembly 24, which distributes the air evenly to the upper face of bed 23. From there, air is drawn down through the entire carbon bed 23, desorbing fuel vapor as it flows. The air and desorbed vapor passes through bottom screen assembly 26 and into the plenum formed by bottom end cover 20. Purge flow then proceeds up the central purge tube 36 and ultimately to the engine to be burned. The centralized location of purge tube 36 creates an even and symmetrical purge pattern, just as the central location of cup 28 yields an efficient vapor loading pattern. The application of vacuum to the bed 23 enhances the evaporation of trapped liquid fuel through the grid 32, but cup 28 is bypassed by the purge flow. Thus, liquid fuel is trapped, isolated from carbon bed 23, and continually removed, but without feeding liquid fuel directly to the engine during purge. The engine mixture is therefore not over enriched during purge.

Variations of the preferred embodiment could be made. A purge tube could enter the canister housing 16 at some other location, so long as it was remote from the grids 32, which assures that liquid cannot be drawn directly from cup 28. Having purge tube 36 enter the plenum below cup 28 assures that remote relation, as well as assuring that purge air is drawn all the way down and evenly through the adsorbent bed 23. The purge and fill tubes would not necessarily have to be central to and coaxial with canister housing 16, so long as the fill tube opened to the cup 28, and the purge tube did hot. The central and coaxial relation of purge tube 36 and fill tube 38 is space efficient, however, and assures a symmetrical and even fill and purge of bed 23. Likewise, running the purge tube 36 centrally through cup 28 is space efficient, and allows the lower end of purge tube 36 to be solidly supported by the cup 28 and integral bottom screen and plate assembly 26. The coextensive tubes 36 and 38, and cup 28, with its socket 34, together provide a solid structural spine for canister housing 16. A different shaped cup could be used, but the conical cap provides extra surface area for the vapor interface with the carbon bed 23, as opposed to a flat top. Likewise, the socket 34 and coaxial stand pipe 30 cooperate with the central coaxial purge and fill tubes 36 and 38 to allow all components to interfit easily when they are assembled together. Therefore, it will be understood that it is not intended to limit the invention to just the embodiment disclosed.

The embodiments of the invention in which an exclusive property or privilege is claimed are defined as follows:

1. A fuel emissions storage canister of the type that receives a mixture of fuel vapor and entrained liquid fuel vented from a vehicle fuel tank, and in which a vehicle engine provides a source of engine vacuum to purge stored fuel from said canister to be burned in said engine, said canister comprising, a canister housing, a fuel vapor adsorbent bed substantially filling said housing and having an upper face and a lower face, air intake means opening through said housing from atmosphere to said adsorbent upper face, a cup located within said said housing near said absorbent bed lower face so as to create an interior cavity within said adsorbent bed, said cup being closed but for an upper grid presented to the interior of said adsorbent bed, a cover forming a plenum beneath said adsorbent bed lower face and beneath said cup that is open to said cup only indirectly through said adsorbent bed and grid, a purge tube connected to engine vacuum and extending through said housing and into said plenum, and, a fill tube connected to said fuel tank and extending through said housing and into said cup, whereby, when said mixture is vented from said fuel tank into said fill tube it initially enters only said cup, from which cup the vapor component of said mixture enters said adsorbent bed indirectly through said cup grid while the entrained liquid component of said mixture collects in said cup below said grid to enter said adsorbent bed only after vaporizing through said grid, and, when engine vacuum is introduced through said purge tube, atmospheric air drawn into said vent means and down through said adsorbent bed upper face. through said adsorbent bed and out said adsorbent bed lower face into said plenum and purge tube, thereby bypassing said cup and purging only vaporized fuel from said adsorbent bed to said engine.

2. A fuel emissions storage canister of the type that receives a mixture of fuel vapor and entrained liquid fuel vented from a vehicle fuel tank, and in which a vehicle engine provides a source of engine vacuum to purge stored fuel from said canister to be burned in said engine, said canister comprising, generally cylindrical canister housing, a fuel vapor adsorbent bed substantially filling said housing and having an upper face and a lower face, air intake means opening through said housing from atmosphere to said adsorbent upper face, a cup located centrally within said said housing near said absorbent bed lower face so as to create an interior cavity within said adsorbent bed, said cup being closed but for an upper grid presented to the interior of said adsorbent bed, a cover forming a plenum beneath said adsorbent bed lower face and beneath said cup that is open to said cup only indirectly through said adsorbent bed and grid, a central purge tube connected to engine vacuum and extending continuously through said housing and cup into said plenum, and, a central fill tube connected to said fuel tank and extending through said housing in surrounding relation to said purge tube and to said cup, whereby, when said mixture is vented from said fuel tank into said fill tube it initially enters only said cup, from which cup the vapor component of said mixture enters said adsorbent bed indirectly through said cup grid and migrates evenly radially outwardly therefrom while the entrained liquid component of said mixture collects in said cup below said grid to enter said adsorbent bed only after vaporizing through said grid, and, when engine vacuum is introduced through said purge tube, atmospheric air drawn into said vent means and down through said adsorbent bed upper face, through said adsorbent bed and out said adsorbent bed lower face into said plenum and purge tube, thereby bypassing said cup and purging only vaporized fuel from said adsorbent bed to said engine.

* * * * *